US007308735B2

(12) United States Patent
Chehab et al.

(10) Patent No.: US 7,308,735 B2
(45) Date of Patent: Dec. 18, 2007

(54) ROLLER PAIR FOR STRETCHING STRIPS OF FILTER MATERIAL

(75) Inventors: Firdausia Chehab, Hamburg (DE); Stefan Fietkau, Westerau/DE (DE)

(73) Assignee: International Tobacco Machinery B.V., Kampen (NL)

( * ) Notice: Subject to any disclaimer, the term of this patent is extended or adjusted under 35 U.S.C. 154(b) by 270 days.

(21) Appl. No.: 10/518,130

(22) PCT Filed: May 20, 2003

(86) PCT No.: PCT/EP03/05287

§ 371 (c)(1),
(2), (4) Date: Sep. 16, 2005

(87) PCT Pub. No.: WO04/000046

PCT Pub. Date: Dec. 31, 2003

(65) Prior Publication Data

US 2006/0179615 A1 Aug. 17, 2006

(30) Foreign Application Priority Data

Jun. 20, 2002 (DE) ..... 102 27 378

(51) Int. Cl.
*D01H 5/74* (2006.01)

(52) U.S. Cl. ..... 19/261

(58) Field of Classification Search ..... 19/261, 19/65 T; 492/16, 45
See application file for complete search history.

(56) References Cited

U.S. PATENT DOCUMENTS

| | | | | |
|---|---|---|---|---|
| 2,790,208 | A | 4/1957 | Smith | 19/66 |
| 3,220,083 | A | 11/1965 | Crawford | 28/1 |
| 3,747,863 | A * | 7/1973 | Klementz et al. | 242/364.11 |
| 3,951,809 | A * | 4/1976 | Kollmar | 210/241 |
| 4,759,247 | A * | 7/1988 | Bell et al. | 83/346 |
| 5,678,774 | A * | 10/1997 | Bennett et al. | 241/27 |
| 6,267,712 | B1 * | 7/2001 | Franke | 492/16 |
| 2001/0036888 | A1 * | 11/2001 | Franke | 492/16 |
| 2003/0199376 | A1 * | 10/2003 | Schnyder et al. | 492/7 |
| 2006/0053593 | A1 * | 3/2006 | Gombash, Jr. | 19/66 T |
| 2006/0183613 | A1 * | 8/2006 | Niemeyer | 492/7 |
| 2006/0260100 | A1 * | 11/2006 | Duda et al. | 19/236 |

FOREIGN PATENT DOCUMENTS

| | | |
|---|---|---|
| DE | 2008033 | 11/1970 |
| DE | 1532142 | 5/1971 |
| GB | 1068384 | 4/1964 |

* cited by examiner

*Primary Examiner*—Shaun R. Hurley
(74) *Attorney, Agent, or Firm*—Vidas, Arrett & Steinkraus, P.A.

(57) ABSTRACT

Roller pair for tensioning strands of filter material in the manufacture of cigarette filters with a first roller made of metal which is rotatably driven by a drive and a second roller of which the surface consists of a resilient material, the two rollers being mounted on one side on a frame or the like and the second roller being pivotally mounted about a horizontal axis perpendicular to its longitudinal axis, away from the first roller and towards the latter, and an actuation device for pivoting the second roller, the second roller able to be driven by a drive via a second drive shaft and an articulated shaft and being mounted such that the size of the gap between the rollers can be altered along its length to adapt to the thickness of the material.

10 Claims, 5 Drawing Sheets

ROLLER PAIR FOR STRETCHING STRIPS OF FILTER MATERIAL

CROSS-REFERENCE TO RELATED APPLICATIONS

Not Applicable

STATEMENT REGARDING FEDERALLY SPONSORED RESEARCH

Not Applicable

BACKGROUND OF THE INVENTION

The filters of filter cigarettes are generally manufactured from a so-called filter tow made from cellulose acetate. It is removed from a bale of cellulose acetate and formed into a web or a strand, before it is passed to the machine in which the filter plugs are manufactured. The 'tow' removed from the bale is highly crimped and is therefore subjected to tensile stress to spread it out. To this end two roller pairs are provided spaced apart, of which that located to the front in the direction of transport is driven with greater speed than that to the rear, in order thereby to create tension.

The roller pairs used until now are mounted with one end on the frame of the machine, one roller consisting of metal and the other comprising a surface layer made from resilient material, for example rubber or the like. Such provisions are disclosed in, amongst others, DE 1 532 142 or DE 2 008 033.

In the known roller pairs the roller located above and consisting of metal is driven, whilst the lower roller is mounted to run with it. To thread the filter tow the lower roller is pivotally mounted about a horizontal axis in the vicinity of its mounting. To actuate the pivoting a linear pneumatic drive is provided.

So that a certain stretching of the tow can be carried out without slipping, the lower roller has to be pressed with relatively high press force. As a result, however, the rubber coating of the lower roller is subjected to not inconsiderable wear and tear.

The object of the invention is to modify a roller pair of the aforementioned type to such an extent that wear and tear is reduced.

According to the invention, the second roller can also be driven by a drive via a second drive shaft and an articulated shaft. According to an embodiment of the invention the second drive shaft is coupled via a gear mechanism to the first drive shaft. Therefore an additional drive is not required.

According to the invention, moreover, the second roller is mounted such that the size of the gap between the rollers can be altered along its length depending on the thickness of the material.

According to the invention, the pressure has to be only so great that the acetate threads can be secured between the roller pairs which are spaced apart, in order to stretch them by a certain proportion. In this manner the wear and tear of the coating of the second roller is markedly reduced.

According to the invention, the second roller is mounted not only so that it can swing away from the first roller but also during operation can carry out limited pivoting or undergo an adjustment parallel to itself, when this is appropriate due to the thickness of the material. The resistance which has to be overcome during such a movement of the second roller is that of the pivot drive which therefore acts upon the second roller in an appropriate manner via a spring medium. This can, for example, occur because the actuation device for its part contains a compressed air cylinder which automatically allows limited pivoting of the roller. Alternatively, a further actuation device can act upon the pivoting of the second roller via a spring medium.

According to a further embodiment of the invention, the second roller is coupled via a universal joint shaft to the second drive shaft. The second drive shaft can, as already mentioned, be the drive shaft of a gear mechanism of which the input shaft represents the motor shaft.

According to a further embodiment of the invention, the second roller is hollow. A drive flange is fastened in the interior which cooperates with a roller bearing of which the inner ring is pivotally mounted about a horizontal axis on a sleeve-shaped bearing component. The articulated shaft is passed through the sleeve-shaped component. The sleeve-shaped component is for its part again pivotally mounted on the frame about a horizontal axis. As a result, on the one hand the bearing component is pivotally mounted and can transmit this movement to the roller. On the other hand the roller is for its part pivotally mounted on the bearing component, so that it can also be adjusted parallel to itself, for the purpose of adapting to the thickness of the filter tow.

BRIEF SUMMARY OF THE INVENTION

The roller pair, including the gear parts, can be arranged, such that it can be attached to a conventional roller drive. According to an embodiment of the invention the frame comprises a vertical base plate on which the drive motor is flange-mounted on one side, as is known per se. On the opposing side of the plate a gear housing for the gear mechanism is attached, which for its part allows the mounting of the second roller. According to the invention, only a small cost is therefore required when the roller pairs are exchanged in a filter manufacturing machine. The rollers, together with the gear housing and the gear mechanism received therein can be attached as a unit to the conventional base plate.

When using a single drive for the two rollers, high manufacturing tolerances are required, so that the two rollers run at the same speed. If this is not the case, friction leads to wear and tear. Alternatively, a second drive can therefore be provided for the second roller which preferably runs with a torque which compensates the bearing friction. The speed of the second drive is adjusted, such that the peripheral speed of the two rollers is the same, so that friction does not occur in the roller gap.

By means of the second drive, which, for example, can be an air motor or a hydraulic motor, the pressure can be reduced between the rollers as the frictional forces of the bearing no longer have to be overcome.

When using a compressed air motor, care must be taken that it reacts relatively slowly. Therefore according to an embodiment of the invention a freewheel mechanism is provided for the rapid start-up phase of the machine up to production speed. As a result, the second roller can follow the first. It can possibly be required to increase the pressure briefly during this start-up phase.

The last described system presents a relatively flexible drive which can very easily even out fluctuations in speed and ensures that the upper and lower rollers operate in unison.

BRIEF DESCRIPTION OF THE DRAWINGS

The invention will be described hereinafter with reference to the drawings, in which.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
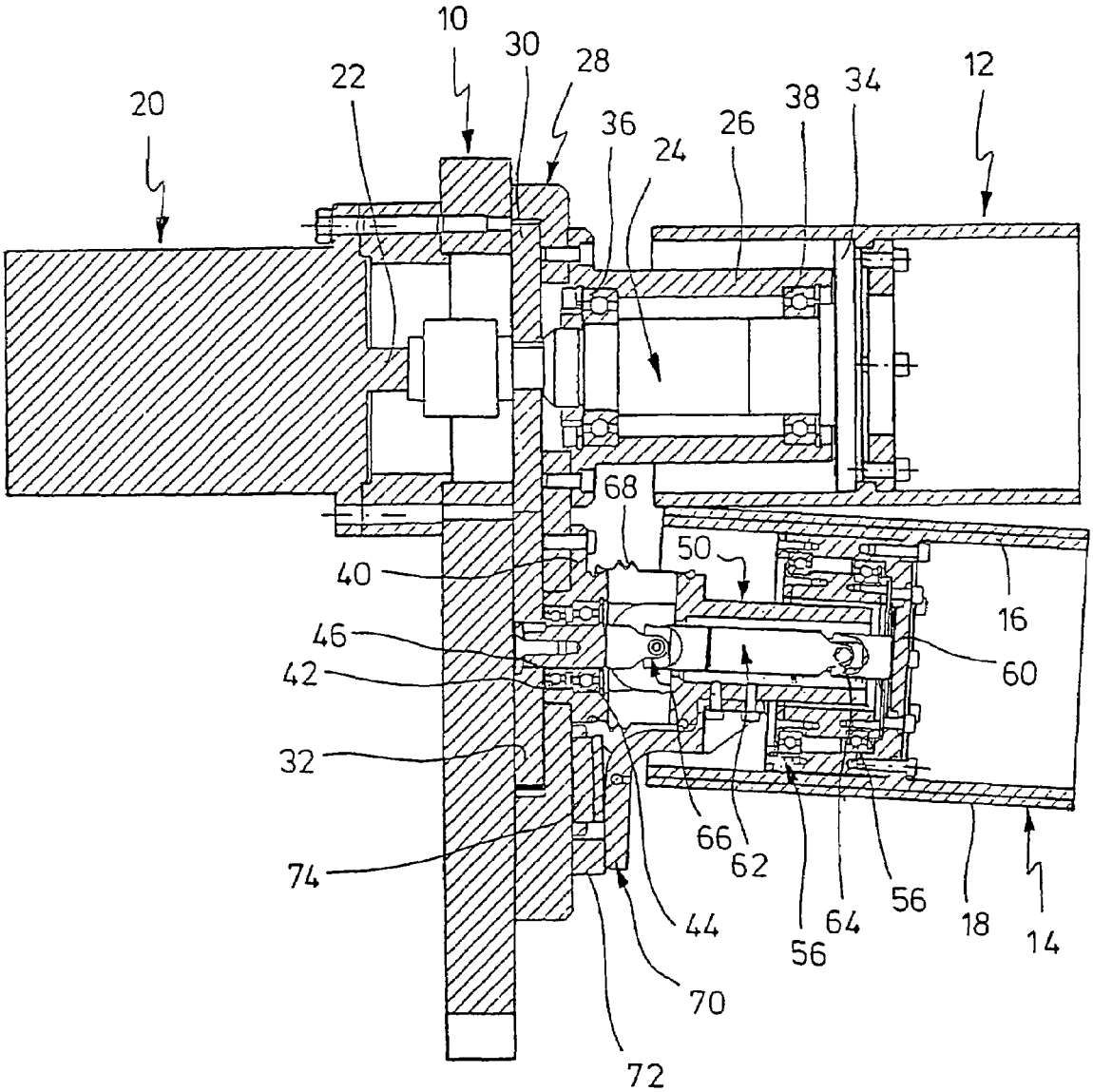
FIG. 1 shows a section through a roller pair according to the invention with the lower roller open.
Figure 2:
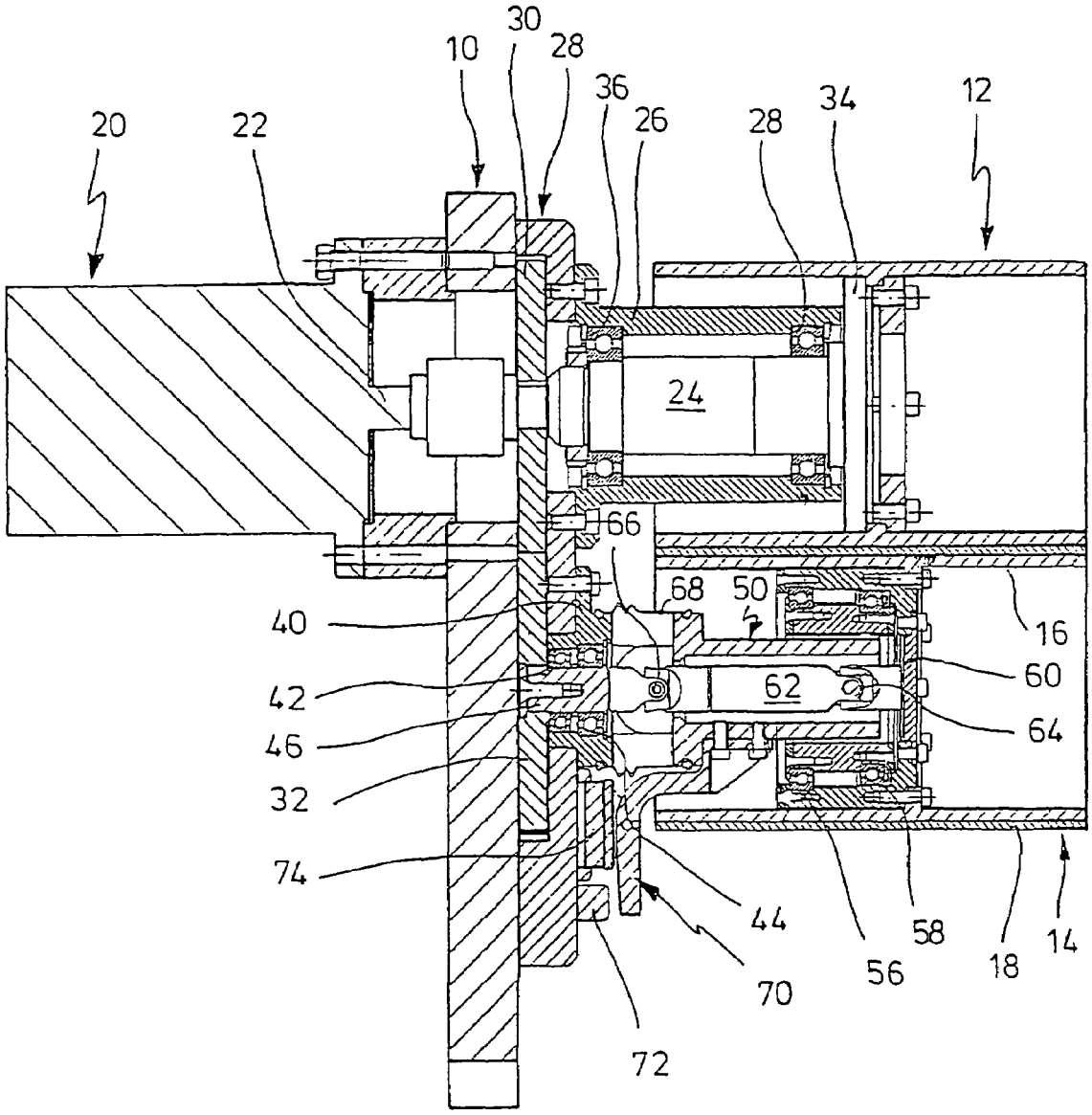
FIG. 2 shows the arrangement of FIG. 1 with the lower roller closed.
Figure 3:
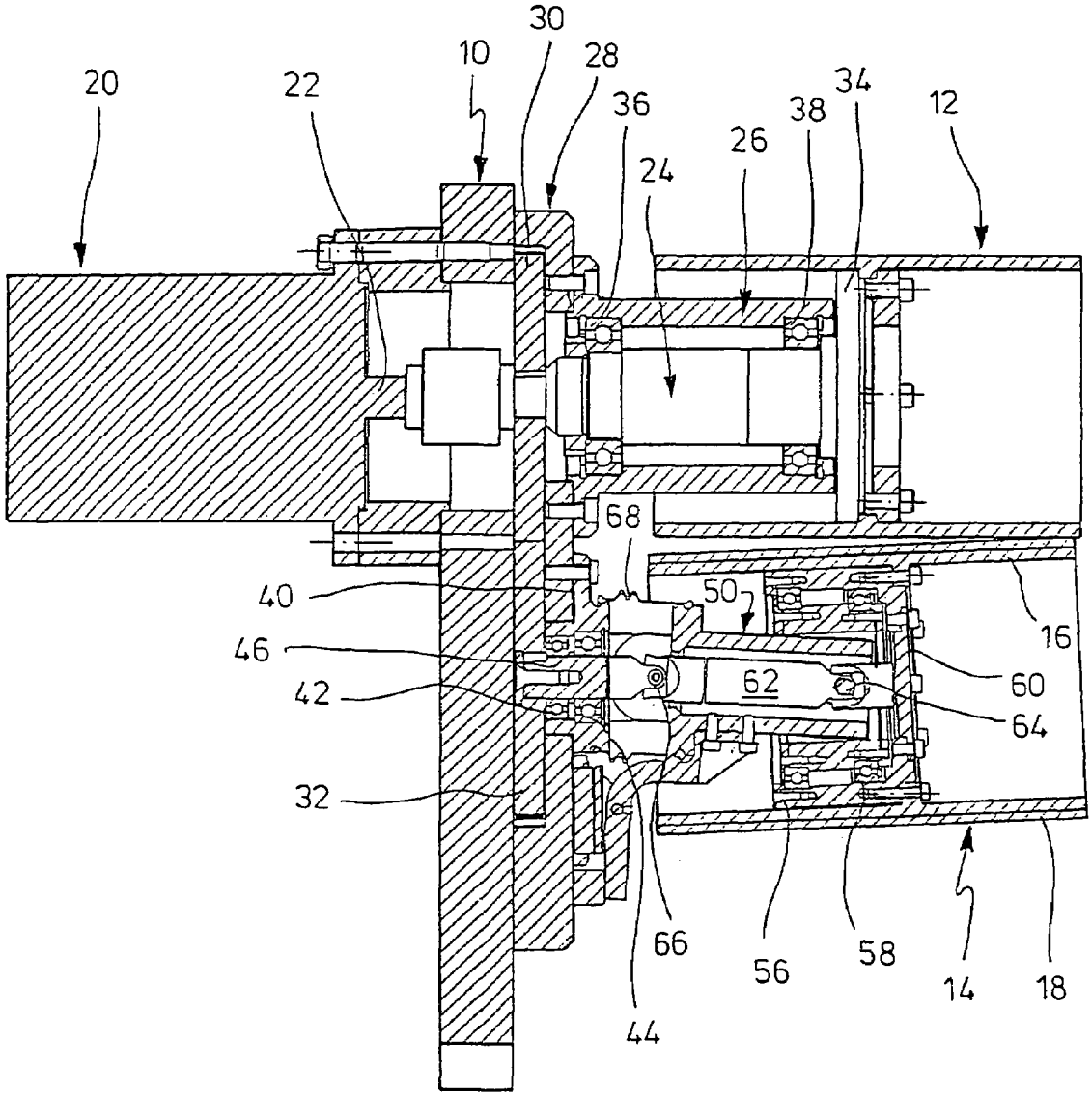
FIG. 3 shows the arrangement according to FIG. 1 in a similar view.
Figure 4:
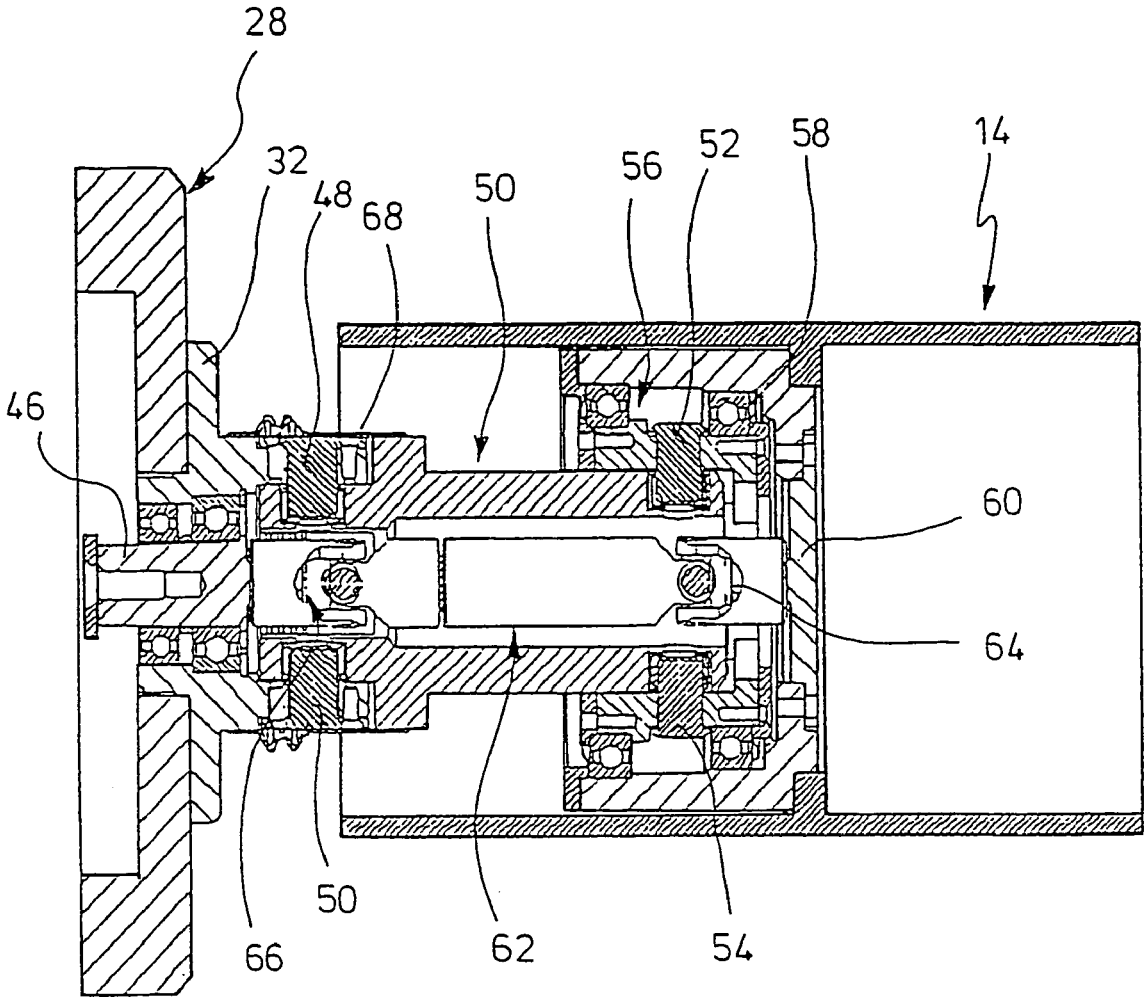
FIG. 4 shows a section through the lower roller according to the view according to FIG. 1 but with a section perpendicular to the section according to FIG. 1.

In FIGS. 1 to 4 a base plate 10 can be seen which is a component part of a machine frame of a machine which serves for the processing a so-called filter tow. Included in this equipment are two pairs of rollers, one of which is shown in FIGS. 1 to 3. The second pair can have a similar construction or be conventionally designed.

In FIGS. 1 to 3 an upper roller 12 and a lower roller 14 can be seen. The upper hollow roller consists of metal, whilst the lower roller 14 comprises a hollow metal cover 16 and a rubber coating 18.

On the left side of the vertical base plate 10 an electric motor 20 is flange mounted. Its drive shaft 22 is coupled via a coupling to a further shaft 24, which extends into a sleeve-shaped bearing body 26. The bearing body 26 is flange mounted on a gear housing 28 which receives two spur gears 30, 32. The spur gear 30 is seated on the shaft 24 and meshes with the second spur gear 32. The gear ratio is 1:1. The gear housing 28 is fixedly connected to the base plate 10.

The shaft 24 is rotationally fixedly connected to a flange 34 which for its part is clamped within the roller 12. A rotation of the shaft 24 therefore leads to a corresponding rotation of the roller 12. The roller 12 is held centrally only at one point. The load bearing is carried out by the shaft 24 which is mounted within the bearing body 26 with the aid of roller bearings 36, 38.

A bearing flange 40 is connected to the outer face of the gear housing 30 by screw fixings which rotatably mount a pin 46 by means of two roller bearings 42, 44 and which is rotationally fixedly connected to the lower spur gear 32.

With the aid of two diametrically opposing pivot pins 48, 50 a sleeve-shaped bearing component 50 is pivotally mounted by the bearing flange 32. In FIGS. 1 to 3, this mounting is carried out about a horizontal axis. As is further revealed in FIG. 4, the sleeve-shaped bearing component 50 with the aid of two diametrically opposing pivot pins 52, 54 supports the inner rings of two roller bearings 56, 58. The outer ring of the bearing 56, 58 is rotationally fixedly connected to the inner face of the roller 14.

A flange 60 is connected to the outer ring of the roller bearing 56, 58 and with which the righthand end of an articulated shaft 62 is rigidly coupled. The articulated shaft comprises a first universal joint 64 and a second universal joint 66, hinging being carried out by the latter on the pin 46. As can be seen, the articulated shaft 62 extends through the interior of the sleeve-shaped bearing component 50. Its interior is protected against the entry of dirt by a protective membrane 68.

On the sleeve-shaped bearing component 50 an angular component 70 is screwed to the underside which in FIG. 1 rests on a stop 72 which is connected to the gear housing 28. On the lower arm of the component 70 a pneumatic variable cylinder arrangement 74 is hinged. With the aid of the variable cylinder arrangement 74 the lower roller can therefore be pivoted upwardly as is shown in FIG. 2. The pressure with which the two rollers 12, 14 are pressed against one another is determined by the pressure in the cylinder arrangement 74.

During operation, as is shown in FIG. 2, not only the upper roller 12 is driven, but also the lower roller 14 and in particular synchronously. The disclosed mounting of the lower roller 14 however allows a tilting of the lower roller 14 during operation, as is shown in FIG. 3 or even a tilting in the opposite direction as is shown in FIG. 3. Finally, it is also possible to space the roller 14*a* by a more or less large gap from the upper roller 12. In this connection the longitudinal axes of the rollers 12, 14 extend parallel to one another, whilst the articulated shaft 62 and also the bearing component 50 are inclined downwardly. The drive of the lower roller 14, however, takes place unchanged.

Figure 5:
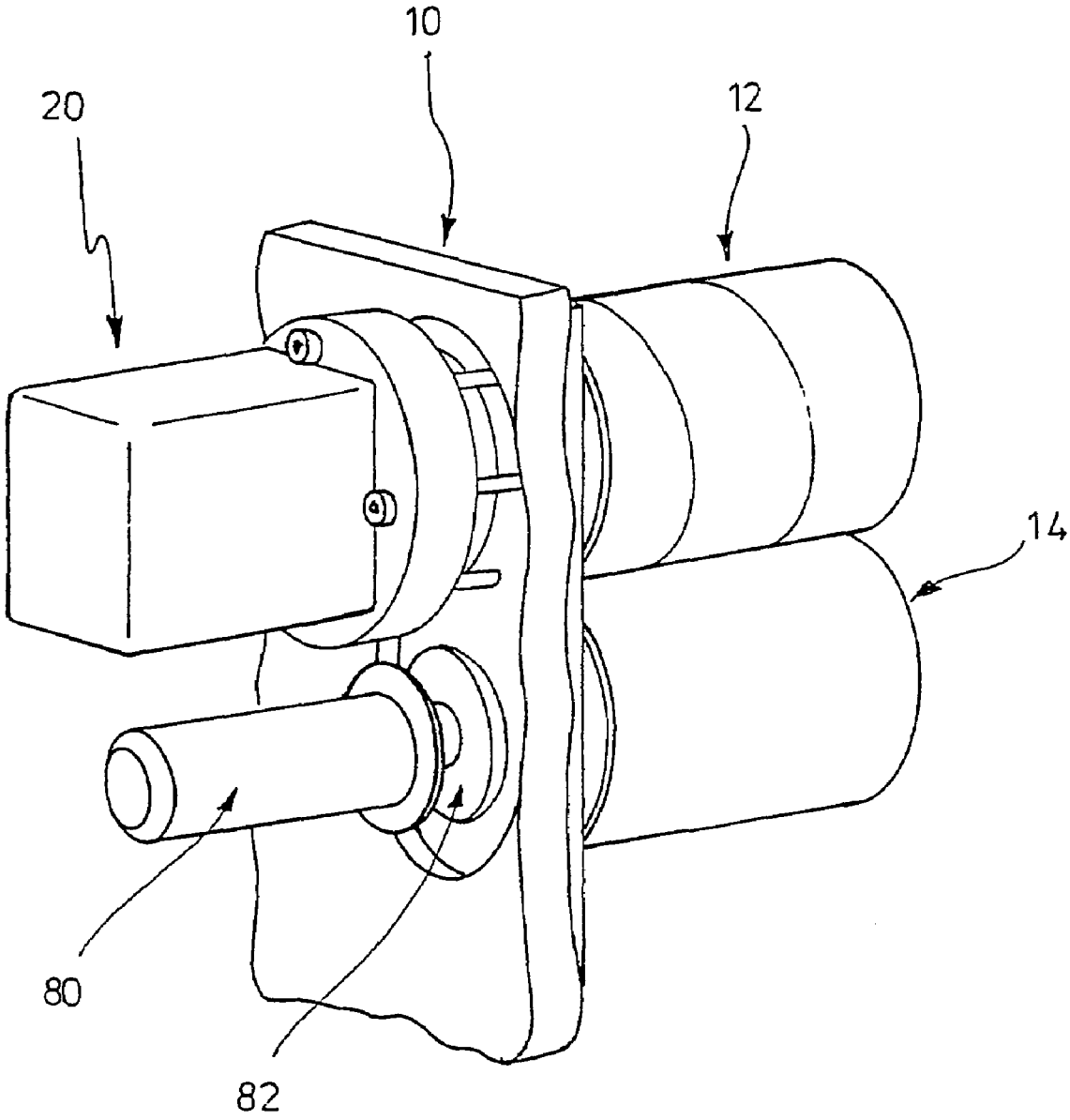
FIG. 5 shows in perspective a second embodiment of a roller pair according to the invention.

It should also be mentioned that instead of the articulated shaft shown, other articulated shafts can be used or a resilient shaft in one piece In the embodiment according to FIG. 5, two rollers 12 and 14 are again used which can be compared to the rollers 12 and 14 according to FIGS. 1 to 4. The upper roller 12 is driven by the electric motor 20. This also corresponds in this respect to the aforementioned embodiment. The lower roller 14 is driven by a separate compressed air motor 80 which is coupled to the lower roller 14 by a freewheel mechanism 82. The compressed air motor 80 is driven at a speed which ensures that the two rollers 12, 14 have the same peripheral speed. The adjusted torque of the compressed air motor 80 compensates the frictional wear and tear of the bearing. The pivoting of the lower roller 14 can be carried out in the same manner as disclosed in the above embodiment.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. Roller pair for tensioning strands of filter material in the manufacture of cigarette filters with a first roller made of metal which is rotatably driven by a drive and a second roller of which the surface consists of a resilient material, the two rollers being mounted on one side on a frame or the like and the second roller being pivotally mounted about a horizontal axis perpendicular to its longitudinal axis, away from the first roller and towards the latter, and an actuation device for pivoting the second roller, characterised in that the second roller (14) can be driven by a drive (20) via a second drive shaft (46) and an articulated shaft (62) and is mounted such that the size of the gap between the rollers (12, 14) can be altered along its length to adapt to the thickness of the material.

2. Roller pair according to claim 1, characterised in that the second roller (14) is coupled via an universal joint shaft (62) to the second drive shaft (46).

3. Roller pair according to claim 1, characterised in that the second drive shaft (42) is coupled via a gear mechanism (30, 32) to the first drive shaft (22).

4. Roller pair according claim 1, characterised in that the second roller (14) is hollow and inside comprises a drive flange (60) which is pivotally mounted by means of a roller bearing (56, 58) about a horizontal axis to a sleeve-shaped bearing component (50) through which the articulated shaft (62) is guided and which for its part is pivotally mounted on the frame via a horizontal axis.

5. Roller pair according to claim 3, characterised in that the frame comprises a vertical base plate (10) on which a drive motor (20) is flange mounted on one side, on the other side of the base plate (10) a gear housing (28) for the gear mechanism is attached and the second roller (14) is pivotally mounted on the outer side of the gear housing (28).

6. Roller pair according to claim 3, characterised in that the gear mechanism comprises two spur gears (30, 32).

7. Roller pair according to claim 1, characterised in that the second roller (14) is driven via a separate second drive (80).

8. Roller pair according to claim 7, characterised in that a hydraulic or pneumatic motor (80) is provided as the second drive.

9. Roller pair according to claim 7, characterised in that the second drive (80) is coupled via a freewheel mechanism (82) to the second roller (14).

10. Roller pair according to claim 7, characterised in that the second drive (80) is driven with a torque which compensates the frictional wear and tear of the bearing.

* * * * *